US008269716B2

(12) United States Patent
Shen

(10) Patent No.: US 8,269,716 B2
(45) Date of Patent: Sep. 18, 2012

(54) LIQUID CRYSTAL DISPLAY AND OVERHEAT PROTECTION METHOD THEREOF

(75) Inventor: Chang-Han Shen, Hsinchu (TW)

(73) Assignee: Getac Technology Corporation, Hsinchu (TW)

( * ) Notice: Subject to any disclaimer, the term of this patent is extended or adjusted under 35 U.S.C. 154(b) by 883 days.

(21) Appl. No.: 12/337,487

(22) Filed: Dec. 17, 2008

(65) Prior Publication Data

US 2010/0148702 A1 Jun. 17, 2010

(51) Int. Cl.
*H05B 39/04* (2006.01)

(52) U.S. Cl. ..... 345/102; 345/101; 315/309

(58) Field of Classification Search ..... None
See application file for complete search history.

(56) References Cited

U.S. PATENT DOCUMENTS

| | | | | |
|---|---|---|---|---|
| 6,388,388 | B1 * | 5/2002 | Weindorf et al. | 315/169.3 |
| 2004/0130521 | A1 * | 7/2004 | Kim | 345/102 |
| 2006/0146558 | A1 * | 7/2006 | Chen et al. | 362/555 |
| 2006/0221047 | A1 * | 10/2006 | Tanizoe et al. | 345/102 |
| 2007/0229443 | A1 * | 10/2007 | Sawada et al. | 345/101 |
| 2008/0238860 | A1 * | 10/2008 | Onodera | 345/102 |
| 2009/0179848 | A1 * | 7/2009 | Schmidt et al. | 345/102 |
| 2009/0289580 | A1 * | 11/2009 | Dunn et al. | 315/307 |

* cited by examiner

*Primary Examiner* — Van Chow

(57) ABSTRACT

A liquid crystal display equipped with an overheat protection device and overheat protection method is disclosed. When a temperature sensor measures that the temperature of a LED (Light-Emitting Diode) backlight module is overheated and possibly will cause damage, the overheat protection device descend the luminance of the LED backlight module to lower the temperature inside the liquid crystal display.

11 Claims, 7 Drawing Sheets

LIQUID CRYSTAL DISPLAY AND OVERHEAT PROTECTION METHOD THEREOF

BACKGROUND OF THE INVENTION

1. Field of the Invention

The present invention relates to a liquid crystal display (LCD), and more particularly, to a LCD implemented with an overheat protection method.

2. Related Art

Using light-emitting diode (LED) modules as a backlight source of LCD has become a trend in the global market of electronic device. In general, 15%~25% luminous efficiency of LED is enough to illuminating LCD with economical power consumption and minor heat-dissipation problem.

However, in some high-luminance requirements, more LED chips and higher LED luminous efficiency are required. Mass of heat is thereby generated.

Referring to FIG. 1, a common heat-dissipation solution for LED backlight module in the prior art. The LED backlight module includes a LED light bar having LEDs 1 and a base 2, a light guiding plate 3, an optical file 4, and a LCD panel 5. A wide Aluminum plate 6 or a heat pipe is directly contacted with the base 2 of LED light bars 3 or indirectly contacted with the base 2 through heat-dissipation paste or heat-dissipation tape, so that the massive heat generated by the LED backlight module may be conducted directly to metal housing of LCD or conducted through thermal pad.

However, in some specific operation circumstance (such as usages of the military, police and automobile), aside from the self-generated massive heat of LED, the LCD has to operate under a high temperature environment and the aforesaid heat-dissipation solution is not capable of providing sufficient heat-dissipation efficiency. Such conditions may causes liquefaction of liquid crystal, thermal curvature/deformation of optical film, or phenomenon of non-uniform luminance or various traces formed on the LCD, namely, the MURA defect.

SUMMARY OF THE INVENTION

To solve the aforesaid problems of the prior art, the present invention provides an LCD equipped with a relevant overheat protection method.

In an embodiment of the present invention, a LCD includes a display panel displaying images, a LED backlight module providing light source to the display panel, a luminance control module controlling the luminance of the LED backlight module, and an overheat protection device conducting an protection mechanism, wherein the overheat protection device has an overheat processing module and at least one temperature sensor. When a monitored temperature exceeds a preset protection temperature, the overheat processing module descends the luminance of the LED backlight module through the luminance control module, thereby lowering the temperature and protecting the LCD.

The present invention also proposes an overheat protection method to present the LCD from overheat damage. When the temperature of the LED backlight module is detected too high, a protection mechanism is activated to lower the luminance of the LED backlight module, thereby protecting the LCD from overheat damage.

These and other features, aspects, and advantages of the present invention will become better understood with reference to the following description and appended claims. It is to be understood that both the foregoing general description and the following detailed description are examples, and are intended to provide further explanation of the invention as claimed.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
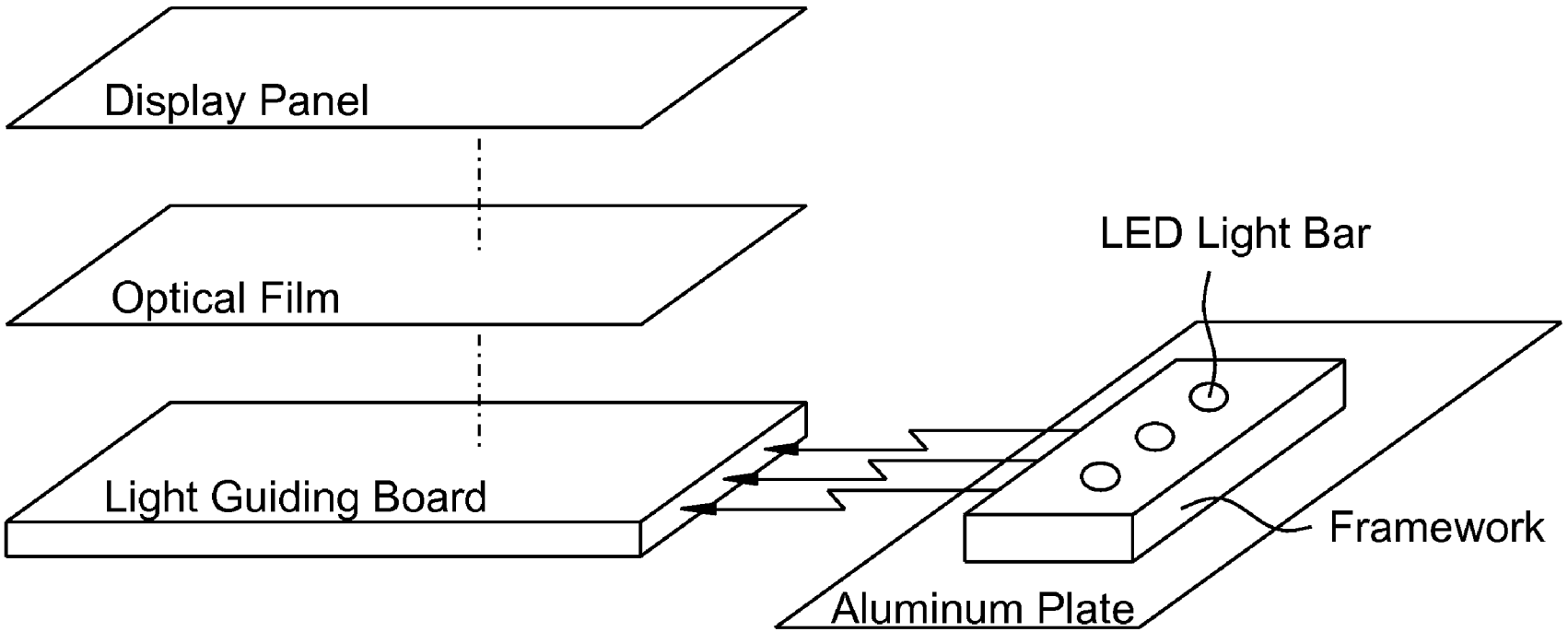
FIG. 1 (PRIOR ART)
FIG. 1 is an explanatory diagram illustrating a LED backlight module in the prior art dissipates heats from aluminum plate.

Reference will now be made in detail to the present preferred embodiments of the invention, examples of which are illustrated in the accompanying drawings. Wherever possible, the same reference numbers are used in the drawings and the description refers to the same or the like parts.

Within LED (Light-Emitting Diode) backlight module of LCD (Liquid Crystal Display), the most serious overheat effects on the whole LCD, such as MURA defects resulted from liquid crystal liquefaction or curvature/deformation of optical film, are the overheat damages to LED light set providing light source, optical film (such as Brightness Enhancement Film, Polarizing Film, Diffusion Film and etc) increasing optical characteristics, and light guiding board 246 guiding light from the LED light set to the display panel. Therefore, the critical temperatures that cause damages of each of the LED light set 242, optical film 244 and light guiding board 246 respectively must be obtained in advance.

Figure 2:
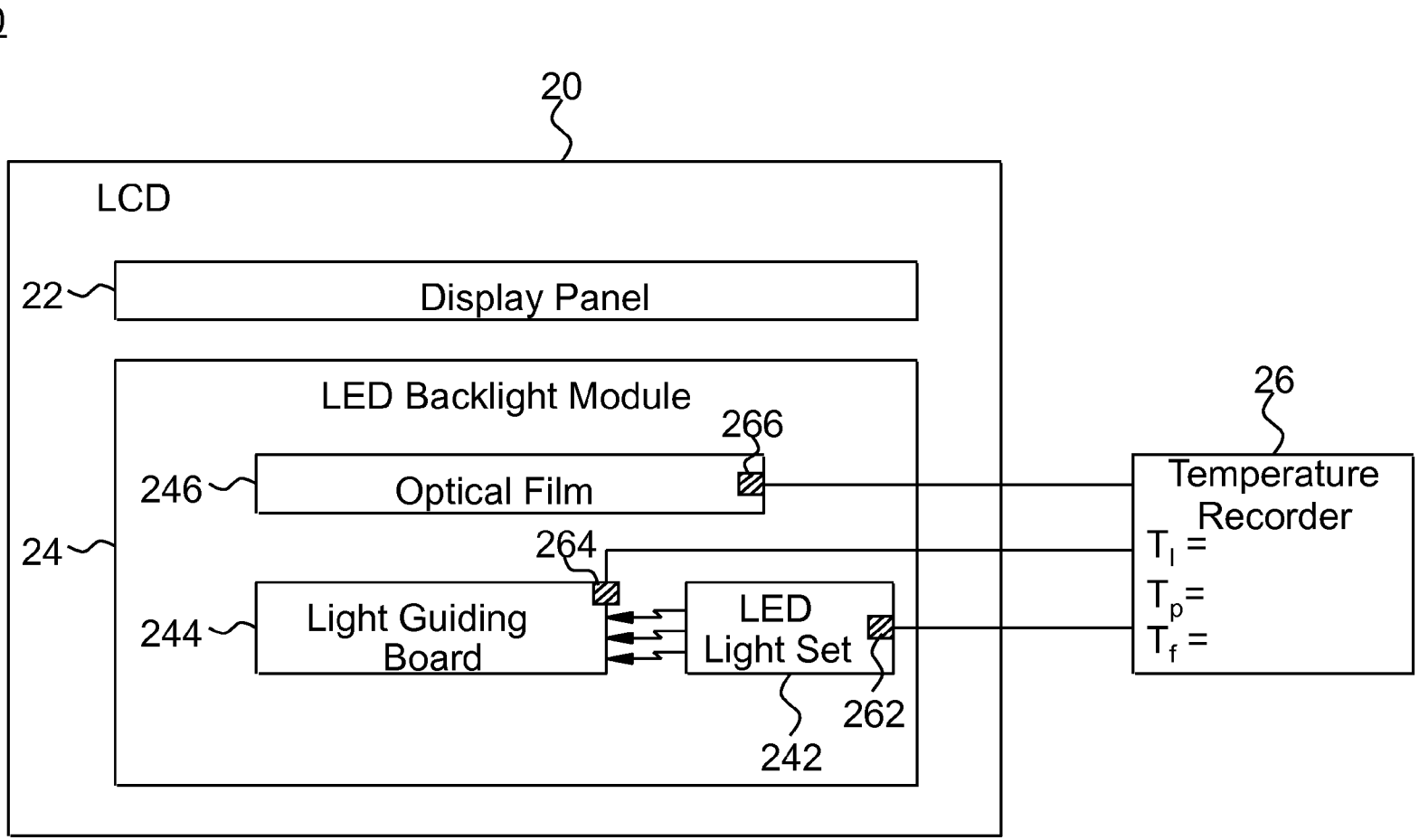
FIG. 2 is an experimental diagram illustrating an approach to obtain a critical temperature of a LED backlight module according to an embodiment of the present invention.

FIG. 2 is an experimental diagram illustrating an approach to obtain a critical temperature of a LED backlight module according to an embodiment of the present invention. First of all, depose a LCD 20 into a thermal chamber 200. The LCD 20 includes a display panel 22 and a backlight module 24; the backlight module 24 has a LED light set 242, a light guiding board 244 and an optical film 246. Ascend the driving current of the LED light set 242 to a maximum output current. And then configure temperature sensors 262, 264, 266 at the LED light set 242, a light entrance of the light guiding board 244 and the optical film 246. During increasing temperature of the heat chamber 200, a temperature recorder 26 records the temperatures of the three sensors. When any of the LED light set 242, the light entrance of the light guiding board 244 or the optical film 246 reaches its critical temperature of overheat damage, the current temperatures Tl, Tp, Tf of the LED light set 242, the light entrance of the light guiding board 244 and the optical film 246 are respectively set as the corresponding protection temperatures of the LED light set 242, the light entrance of the light guiding board 244, and the optical film 246. One of the safer ways is to set the protection temperatures as that the temperatures of damage minus a safe value. To determine whether the backlight module 20 is damaged by overheat, malfunction of the LCD or the appearance of MURA defects may be utilized. The protection temperature of the present invention may be defined as one of the current temperatures Tl, Tp, Tf (upon appearance of MURA defects) of the LED light set, the light guiding board and the optical film minus a safe value. The so-called Mura defect means under the same light source and same background color, the non-uniformity of light source or luminance displayed on the display panel; MUSA defects generally has a relatively low contrast, comparing with the nearby background.

Aside from the LED light set 242, the light entrance of the light guiding board 244 and the optical film 246, an extra fourth measuring point may be detected as well. When any one of the LED light set 242, the light entrance of the light guiding board 244 or the optical film 246 reaches any of the critical temperatures, the temperature of the fourth measuring point may be also recorded by the recorder 26 and set as the protection temperature, aside from recording the temperatures Tl, Tp. The fourth protection temperature may also be the temperature of damage minuses the safe value disclosed above.

Figure 3A:
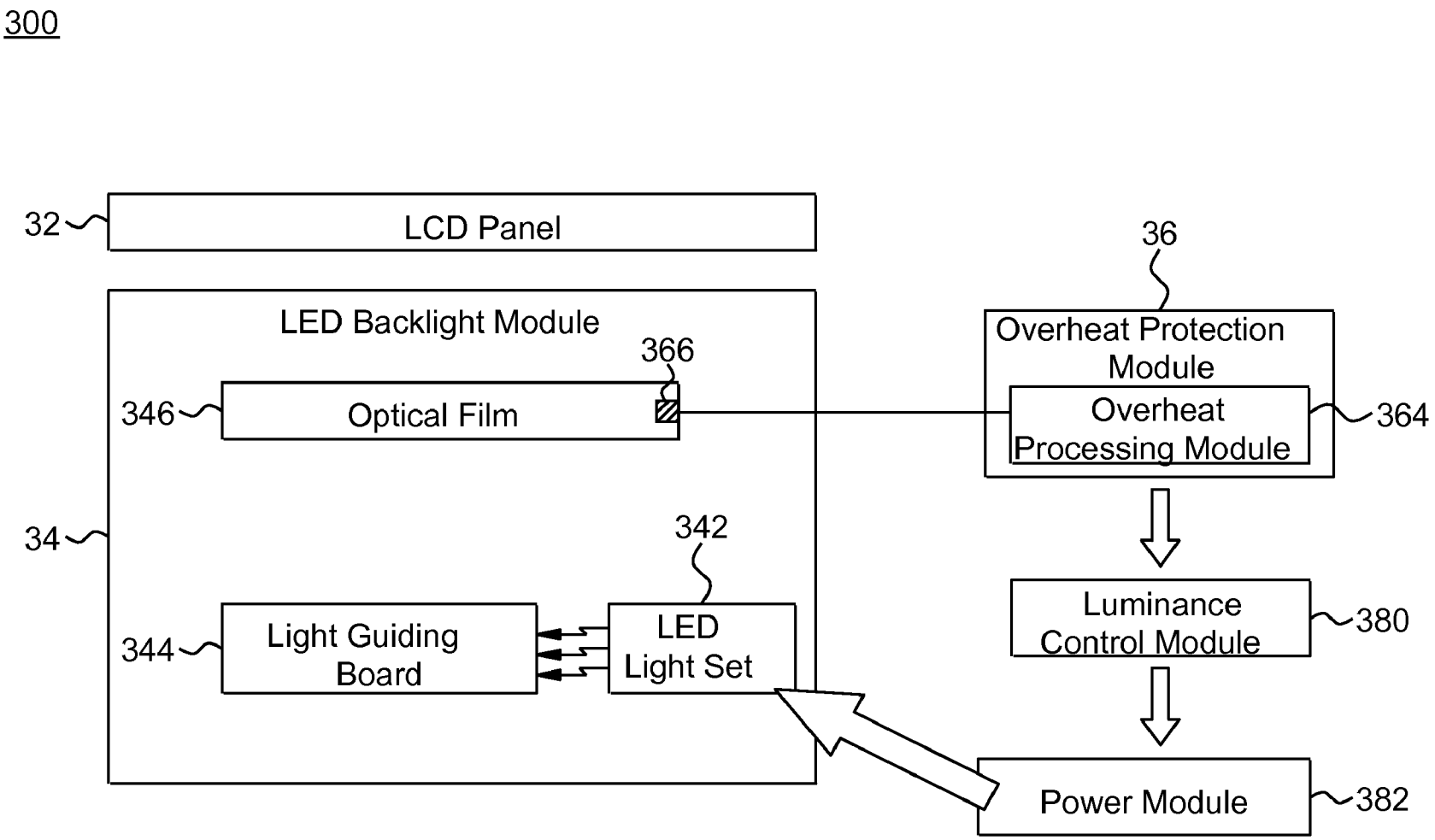
FIG. 3A is a system block diagram of a LCD equipped with overheat protection device according to another embodiment of the present invention.

FIG. 3A is a system block diagram of a LCD equipped with overheat protection device according to another embodiment of the present invention. The LCD system 300 includes a display panel 32, a backlight module 34, a luminance control module 380 and an overheat protection device 36; wherein the backlight module 34 has a LED light set 342, a light guiding board 344 and an optical film 346. The luminance control module 380 controls the luminance of the LED light set 342 by means of controlling the power module 382. The overheat protection device 36 includes at least one temperature sensor 366 to monitor the temperature of the backlight module 34. The temperature sensor 366 may be configured at the LED light set 342, the entrance of the light guiding board 344, the optical film 346 or the fourth measuring point mentioned in the foregoing experiment. The actual position of the temperature sensor 366 is determined by demand and is not limited to those disclosed in the present invention. In FIG. 3A, only one temperature sensor 366 is configured at the optical film 346 as an example. When the monitored temperature of the optical film 346 is higher than its protection temperature Tf (namely any of the LED light set 342, the light guiding board 344 or the optical film 346 has possibly already reached the corresponding critical temperature of damage), the electrically connected overheat processing module 384 will be noticed to conduct a protection mechanism. The overheat processing module 384 will drive the luminance control module 380 to descend the luminance of the backlight module 34 and lower the heat flow for protection purposes. The way to descend the luminance of the backlight module 34 may be realized by descending the current input from the power module 382 to the LED light set 342, or by controlling the PWM (pulse width modulation) circuit within the power module 382 and lower the voltage supplied from the power module 382 to the backlight module 34, thereby lowering the luminance of the backlight module 34.

Figure 3B:
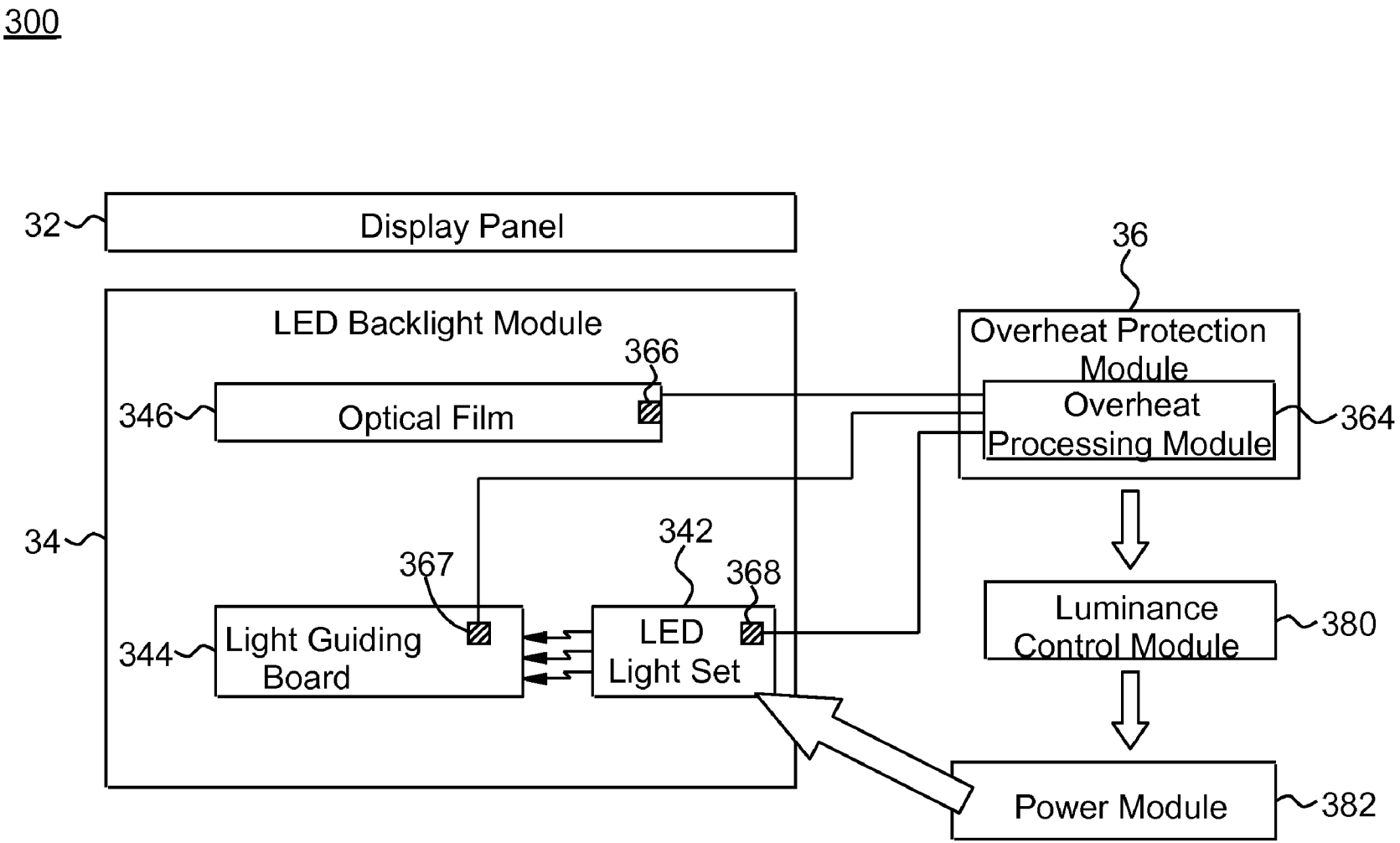
FIG. 3B is another system block diagram of a LCD equipped with overheat protection device according to another embodiment of the present invention.
Figure 4:
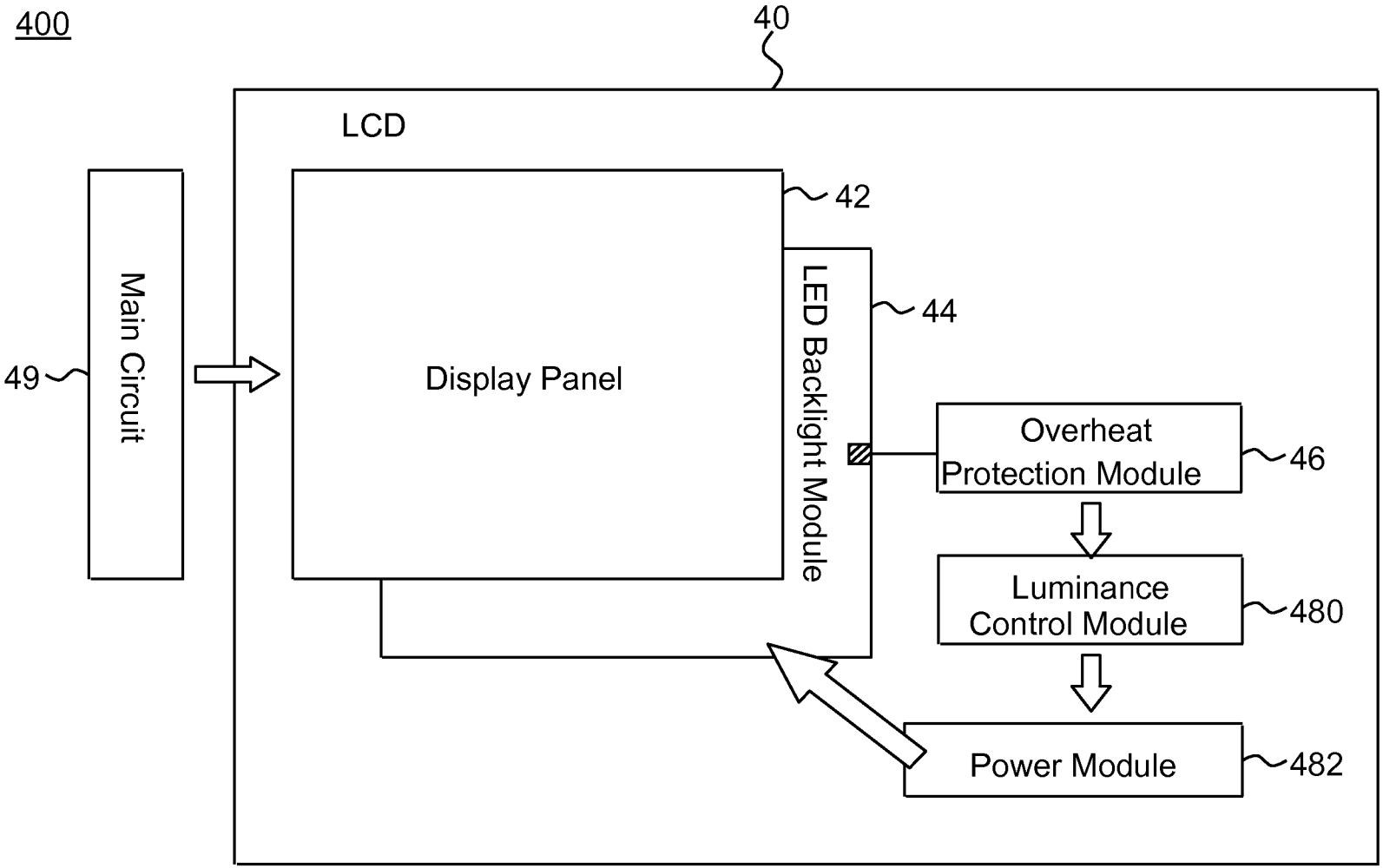
FIG. 4 shows a system block diagram of a computer system that has a LCD equipped with overheat protection device according to another embodiment of the present invention.

In another embodiment, as shown in FIG. 3B, multiple temperature sensors 366~368 may be used to measure the temperatures of the optical film 346, the light guiding board 344 and the LED light set 342. When any temperature ($T_{LED}$, $T_{PLATE}$ or $T_{FILM}$) of the optical film 346, the light guiding board 344 and the LED light set 342 reaches the aforesaid critical temperature, namely when $T_{LED}$>Tl, $T_{PLATE}$>Tp or $T_{FILM}$>Tf, the connected overheat processing module 384 will be noticed, to conduct heat-dissipation mechanism. The overheat processing module 384 will drive the luminance control module 380 to descend the luminance of the backlight module 34 and lower the heat flow for protection purposes. The way to descend the luminance of the backlight module 34 may be the same as those disclosed above in FIG. 3A and corresponding descriptions As shown in FIG. 4, the present invention proposes a computer system 400 which the LCD is applied thereto; wherein the LCD 40 is as the LCD 300 in FIG. 3A. Aside from maintaining the operation of the computer system 400, a main circuit 49 send signals to drive the display panel 42, and the overheat protection device 46 will monitor the temperature(s) of the LED backlight module 44. When the temperature is high than the protection temperature, the luminance control module 480 will be notice immediately, and through changing the output of the power module 482 to descend the luminance of the LED backlight module 44 and further lower the temperature; wherein the luminance control module 480 may be configured inside the LCD 40 or inside the main circuit 49. For instance, the luminance control module 480 may be realized by a display chip.

Figure 5:
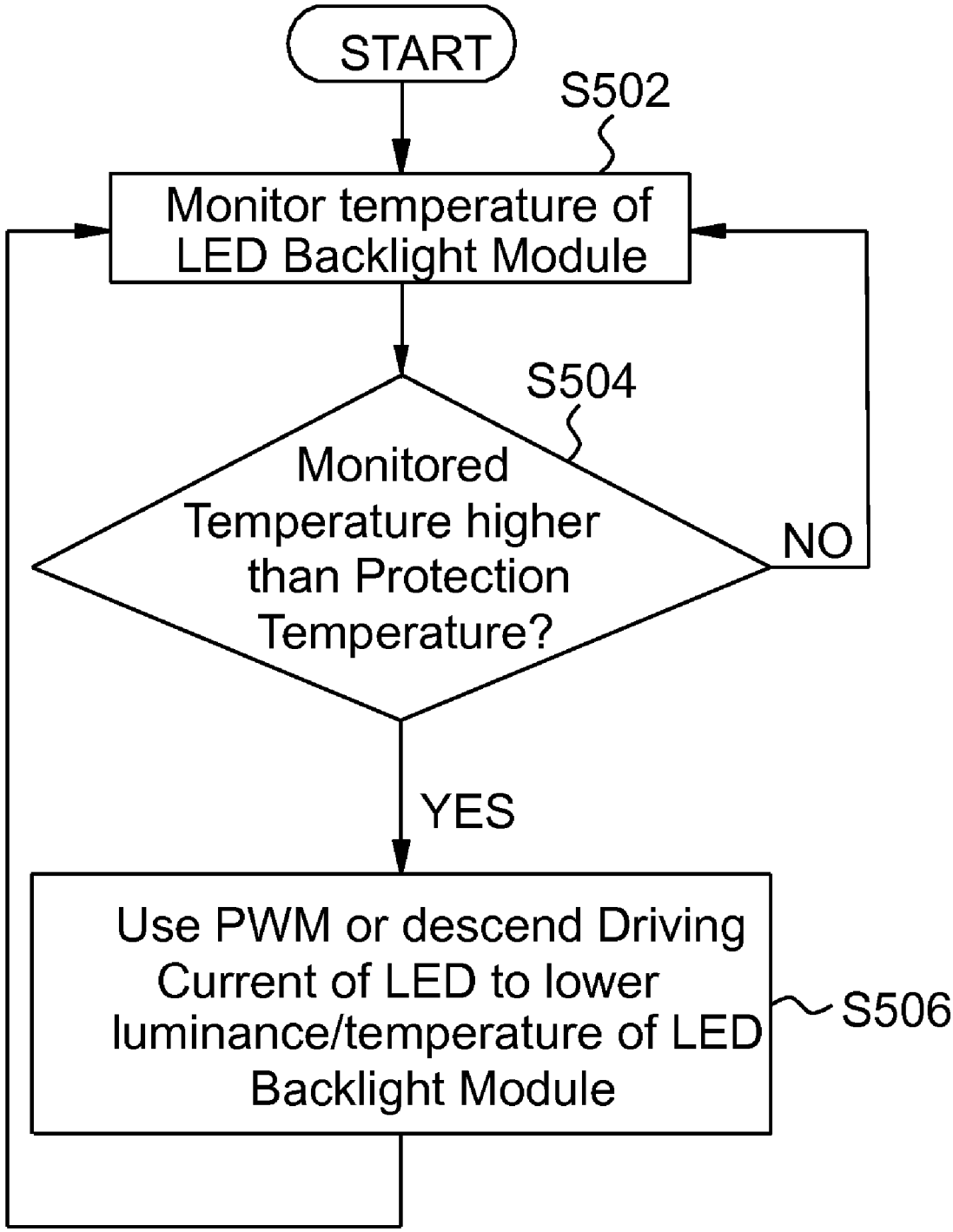
FIG. 5 shows a flow chart of an overheat protection method according to an embodiment of the present invention.

The overheat protection method proposed by the present invention is shown as a flow chart in FIG. 5. First of all, monitor the monitored temperature of the LED backlight module (S502), and compare with the protection temperature (maybe learn from the disclosure within FIG. 2 so as to determine whether the monitored temperature is higher than the protection temperature (S504). If so, control the power module to descend power output (by means of controlling the internal PWM circuit or directly descending the output current of the power module). If not, continuously monitor the temperature of the LED backlight module.

The temperature sensor mentioned in the foregoing sections may be contact type (such as thermal couple) or non-contact type (such as infrared sensor, heat flow sensor). In the present invention, the LCD equipped with an overheat protection device may be applied to any computer system (such as portable computer, desktop, and etc.). Namely, the LCD displays images and is controlled by the computer system. For example, within a notebook computer, said temperature sensor may provide temperature sensing data to bridge chips (south bridge, north bridge or integrated bridge chip) or embedded controller (with internal keyboard controller and other control module built therein) of the computer system; the bridge chip or the embedded controller equipped with keyboard controller may both realize the overheat processing module mentioned in above sections of the present invention.

Figure 6:
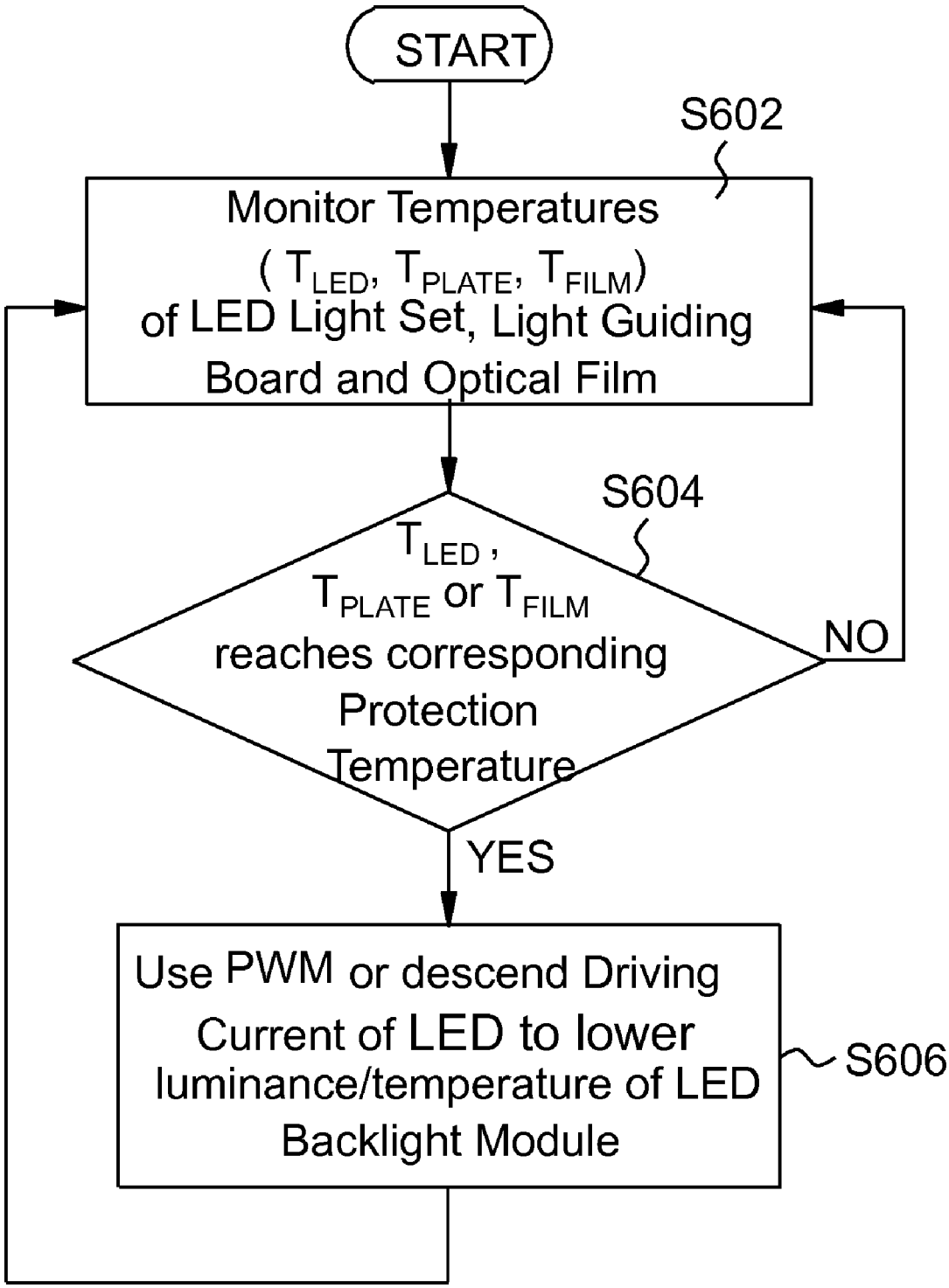
FIG. 6 shows a flow chart of an overheat protection method according to another embodiment of the present invention.

Another overheat protection method proposed by the present invention is shown as a flow chart in FIG. 6. First of all, monitor the temperature of the LED light set, the light guiding board and the optical film within the LED backlight module (S602), such as obtaining the temperature $T_{LED}$, $T_{PLATE}$ and $T_{FILM}$. Next, compare the temperature ($T_{LED}$, $T_{PLATE}$ and $T_{FILM}$) of the LED light set, the light guiding board and the optical film with the protection temperatures Tl, Tp and Tf respectively (may learn from FIG. 2) to determine whether any temperature $T_{LED}$, $T_{PLATE}$ or $T_{FILM}$ reaches the protection temperature; namely to determine whether any of $T_{LED}$>Tl, $T_{PLATE}$>Tp or $T_{FILM}$>Tf is true (Step S604). If yes, control the power module to lower power output (by means of controlling the internal PWM circuit or directly descending the output current of the power module); if not, continuously monitor the temperatures $T_{LED}$, $T_{PLATE}$ and $T_{FILM}$.

Additional advantages and modifications will readily occur to those proficient in the relevant fields. The invention in its broader aspects is therefore not limited to the specific details and representative embodiments shown and described herein. Accordingly, various modifications may be made without departing from the spirit or scope of the general inventive concept as defined by the appended claims and their equivalents.

What is claimed is:

1. A liquid crystal display, comprising:

a display panel displaying images;

a LED (Light-Emitting Diode) backlight module, providing a light source to the display panel, the LED backlight module comprising a LED light set, a light guiding board and an optical film;

a luminance control module, controlling the luminance of the LED backlight module; and an overheat protection device, comprising:

at least three temperature sensors, measuring temperatures of the LED light set, the light guiding board and the optical film respectively; and an overheat processing module, electrically connecting with the temperature sensors, wherein when the temperature sensors measure that any temperature of the LED light set, the light guiding board and the optical film is higher than a respectively corresponding protection temperature, the overheat processing module drives the luminance control module to descend the luminance of the LED backlight module to protect the liquid crystal display.

2. The liquid crystal display as claimed in claim 1, wherein the protection temperature is defined as the temperature of overheat damage of the LED backlight module.

3. The liquid crystal display as claimed in claim 1, wherein the protection temperature is defined as the temperature of overheat damage of the LED backlight module minus a safe value.

4. The liquid crystal display as claimed in claim 1, wherein the protection temperature is defined as the temperature of overheat damage of the LED light set, the LED light set or the light guiding board.

5. The liquid crystal display as claimed in claim 1, wherein the protection temperature is defined as the temperature of overheat damage of the LED light set, the LED light set or the light guiding board minus a safe value.

6. The liquid crystal display as claimed in claim 1, wherein the protection temperature is defined as the temperature of the liquid crystal display generating a MURA defect.

7. The liquid crystal display as claimed in claim 1, wherein the protection temperature is defined as the temperature of the liquid crystal display generating a MURA defect minus safe value.

8. The liquid crystal display as claimed in claim 1 further comprising a power module that provides power to the LED backlight module, wherein the luminance control module control the power module to descend output current to lower the luminance of the LED backlight module.

9. The liquid crystal display as claimed in claim 8, wherein the power module comprises a PWM (pulse width modulation) circuit, and the luminance control module changes the output of the power module by controlling the PWM circuit to lower the luminance of the LED backlight module.

10. An overheat protection method adapted to a liquid crystal display, the liquid crystal display comprising a display panel and a LED (Light-Emitting Diode) backlight module, the method comprising the steps of:

measuring temperature of the LED backlight module and comparing with at least one protection temperature; and descending the luminance of the LED backlight module to protect the liquid crystal display when the temperature of the LED backlight module is higher than the protection temperature;

wherein the LED backlight module comprises a LED light set, a light guiding board and an optical film, and the overheat protection method further comprises the step of:

respectively determining a critical temperature that causes damage to each one of the LED light set, the light guiding board, and the optical film;

establishing a protection temperature corresponding to each one of the LED light set, the light guiding board, and the optical film according to the respective critical temperature; and independently measuring temperatures of the LED light set, the light guiding board and the optical film and comparing with the corresponding protection temperature.

11. The overheat protection method as claimed in claim 10 further comprising the steps of:

descending the luminance of the LED backlight module to protect the liquid crystal display when any one of the temperatures of the LED light set, the light guiding board and the optical film is higher than the protection temperature.

* * * * *